United States Patent [19]

Chamberlain

[11] 4,356,698

[45] Nov. 2, 1982

[54] STAGED COMBUSTOR HAVING AERODYNAMICALLY SEPARATED COMBUSTION ZONES

[75] Inventor: John Chamberlain, Lake Park, Fla.

[73] Assignee: United Technologies Corporation, Hartford, Conn.

[21] Appl. No.: 193,513

[22] Filed: Oct. 2, 1980

[51] Int. Cl.[3] ..... F23R 3/14; F23R 3/32; F23R 3/34

[52] U.S. Cl. ..... 60/733; 60/737; 60/746

[58] Field of Search ..... 60/733, 746, 737, 738; 431/174, 178, 285

[56] References Cited

U.S. PATENT DOCUMENTS

| | | | |
|---|---|---|---|
| 3,653,207 | 4/1972 | Stenger | 60/746 |
| 3,973,395 | 8/1976 | Markowski et al. | 60/746 |
| 4,122,670 | 10/1978 | Reider | 60/733 |
| 4,151,713 | 5/1979 | Faitani | 60/733 |
| 4,173,118 | 11/1979 | Kawaguchi | 60/733 |
| 4,215,535 | 8/1980 | Lewis | 60/736 |
| 4,222,232 | 9/1980 | Robinson | 60/746 |
| 4,265,085 | 5/1981 | Fox et al. | 60/733 |
| 4,265,615 | 5/1981 | Lohmann et al. | 60/746 |

*Primary Examiner*—Robert E. Garrett
*Attorney, Agent, or Firm*—Robert C. Walker

[57] ABSTRACT

A combustion chamber of the type employing staged combustion principles is disclosed. Effective control of undesirable pollutants is sought over a wide range of operating power levels. A specific objective is to separate staged combustion zones without the penetration of structural apparatus into the chamber. Single site fuel injection is desired.

Primary fuel premixing tubes (34) and secondary fuel premixing tubes (38) terminate at the front wall (32) of the combustion chamber (30). The primary fuel premixing tubes have highly angled discharge swirlers at the downstream ends thereof. The highly angled swirlers (66) cause the fuel/air mixture emanating therefrom to burn in close proximity to the front wall. The secondary fuel premixing tubes have lowly angled discharge swirlers, or no swirlers at all, so as to cause the effluent therefrom to penetrate the region at which primary combustion is taking place without significantly influencing the fuel/air ratio at the primary combustion site (P).

2 Claims, 8 Drawing Figures

STAGED COMBUSTOR HAVING AERODYNAMICALLY SEPARATED COMBUSTION ZONES

DESCRIPTION

Technical Field

This invention relates to gas turbine engines and more particularly to the combustion chambers of such engines.

The concepts were developed for specific use with industrial type machines having very large combustion chambers, but are similarly suited to large aviation engines employing either can or annular type combustion chambers.

Background Art

Within the gas turbine engine field, combustion characteristics are among the most difficult to predict and difficult to control. The art is replete with a plethora of ingenious designs and approaches to the achievement of rapid, complete combustion without the production of undesirable pollutants. Nevertheless, control of pollutants remains a problem requiring significant attention.

Perhaps the most imposing anti-pollution objective facing scientists and engineers today is the requirement for reduced levels of nitrous oxide emission. Nitrous oxides are produced, for example, in accordance with the simplified reactions shown below.

$N_2+O_2+\text{Heat}\rightarrow 2NO$ $2NO+O_2\rightarrow 2NO_2$

The reactions require both the presence of oxygen and very high temperatures. Limiting either the oxygen present or the fuel combustion temperatures substantially reduces the levels of nitrous oxide produced. Over a wide range of power settings wherein fuel flow rates vary appreciably, control of the amount of oxygen present without undue mechanical complexity and control of the combustion temperature are difficult parameters to address. One commonly employed technique for controlling local combustion temperatures, and hence the nitrous oxide producing reaction, is the separation of the combustion process into two or more stages. The fuel/air ratio at each stage is separately established to achieve such control.

Staged combustion concepts are divisible into two principal categories: those in which both primary fuel and secondary fuel are introduced at the same location in the burner, and those in which the introduction point of secondary fuel is separated from the introduction of primary fuel. U.S. Pat. Nos. 3,653,207 to Stenger entitled "High Fuel Injection Density Combustion Chamber for a Gas Turbine Engine"; 4,215,535 to Lewis entitled "Method and Apparatus for Reducing Nitrous Oxide Emissions from Combustors"; and 4,151,713 to Faitaini entitled "Burner for Gas Turbine Engines" are illustrative of concepts in which both primary and secondary fuel are injected at the same axial location. In such situations primary and secondary combustion zones are separated by the later introduction of secondary combustion air with the result that secondary combustion is delayed until the previously admitted fuel reaches that zone. U.S. Pat. Nos. 3,973,395 to Markowski et al entitled "Low Emission Combustion Chamber" and 4,173,118 to Kawaguchi entitled "Fuel Combustion Apparatus Employing Staged Combustion" are representative of concepts in which fuel and air for primary combustion are axially separated from fuel and air for secondary combustion. Secondary combustion is accordingly avoided until the requisite fuel and air are later admitted.

Combustors having separated fuel injection zones typically provide greater flexibility in the control of local fuel/air ratios at the primary combustion site. Air cycling through non-operating fuel sites is delivered to the combustor remotely from the primary or operating combustion sites so as not to affect the local fuel/air ratio at the operating sites. Such combustors typically incorporate mechanical constructions or baffles, such as those illustrated in the representative art, for confining the respective zones of combustion. In general, the mechanical complexity of such structures is significantly greater than the mechanical complexity of systems introducing fuel products at a single site.

Effective combination of staged fuel combustion with single site injection and minimal mechanical complexity is sought by scientists and engineers in the gas turbine industry.

Disclosure of Invention

According to the present invention, the primary combustion zone and the secondary combustion zone of a staged combustion chamber are aerodynamically separated in the combustion chamber through the discharge of primary and secondary fuel/air mixtures at differing swirl angles into the front end of the combustion chamber.

According to one specific embodiment of the invention, the front end of a staged combustion chamber has a plurality of primary and secondary fuel premixing tubes disposed at the front end of the combustion chamber with the discharge ends of the tubes terminating at the front wall of the chamber, the primary tubes having a high angle discharge swirler across which a fuel/air mixture is dischargeable such that primary fuel combustion occurs in close proximity to the front end of the combustion chamber and the secondary tubes having a low angle discharge swirler across which a fuel/air mixture is dischargeable such that secondary fuel combustion occurs well downstream of the location at which the primary fuel is burned.

A primary feature of the present invention is the aerodynamic separation of the primary combustion zone from the secondary combustion zone. Both the primary fuel premixing tube and the secondary fuel premixing tube terminate at the front wall of the combustion chamber. The primary fuel premixing tubes have a highly angled discharge swirler disposed at the downstream thereof. The secondary fuel premixing tubes have a relatively lowly angled discharge swirler, or no discharge swirler, disposed at the downstream end thereof. Resultantly, air discharged through the secondary tubes penetrates the zone to which the primary fuel/air mixture is discharged without altering the fuel/air mixture in that region.

A principal advantage of the present invention is the effective control of pollutant emissions which results from the aerodynamic separation of combustion zones. Excellent control of fuel/air ratios in both the primary and secondary combustion zones is achievable. Control is effected by entirely aerodynamic means without the need for placement of cones or other structures in the combustion chamber. The overall engine fuel/air ratio is widely variable, yet local fuel/air ratios at the points of combustion remain essentially constant.

The foregoing, and other features and advantages of the present invention will become more apparent in the light of the following description and accompanying drawing.

BEST MODE FOR CARRYING OUT THE INVENTION

Figure 1:
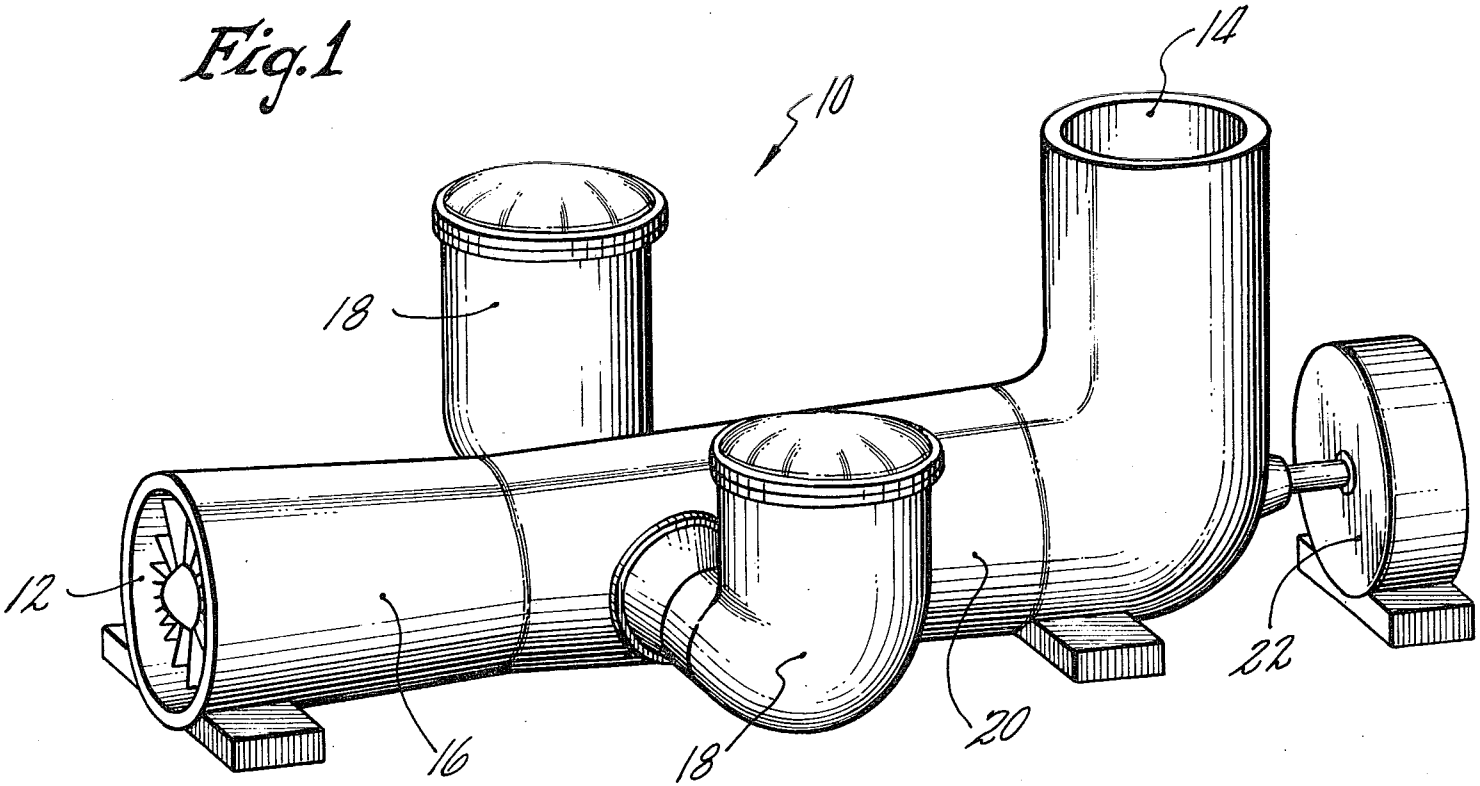
FIG. 1 is a simplified sketch of an industrial gas turbine engine of the type to which the present concepts are applicable.

A gas turbine engine 10 of the type suited to the employ of the concepts of the present invention is illustrated in FIG. 1. The particular engine illustrated is an industrial type engine although the concepts are suited to flight type gas turbine engines as well. The illustrated engine includes an inlet duct 12 and exhaust duct 14. A compressor 16 at the front end of the engine receives air at the inlet duct and compresses the air. Compression ratios on the order of twelve (12) to one (1) are typical for current industrial engines of this type. Fuel is burned with the compressed air under pressure in a combustor 18. The combustor illustrated is of the silo type common to industrial engines. High pressure, high temperature effluent from the combustor is expanded across a turbine 20. A portion of the energy extracted in expansion across the turbine drives the compressor; the remaining energy drives an auxiliary device externally of the gas turbine cycle, such as the electrical generator 22 illustrated.

Figure 2:
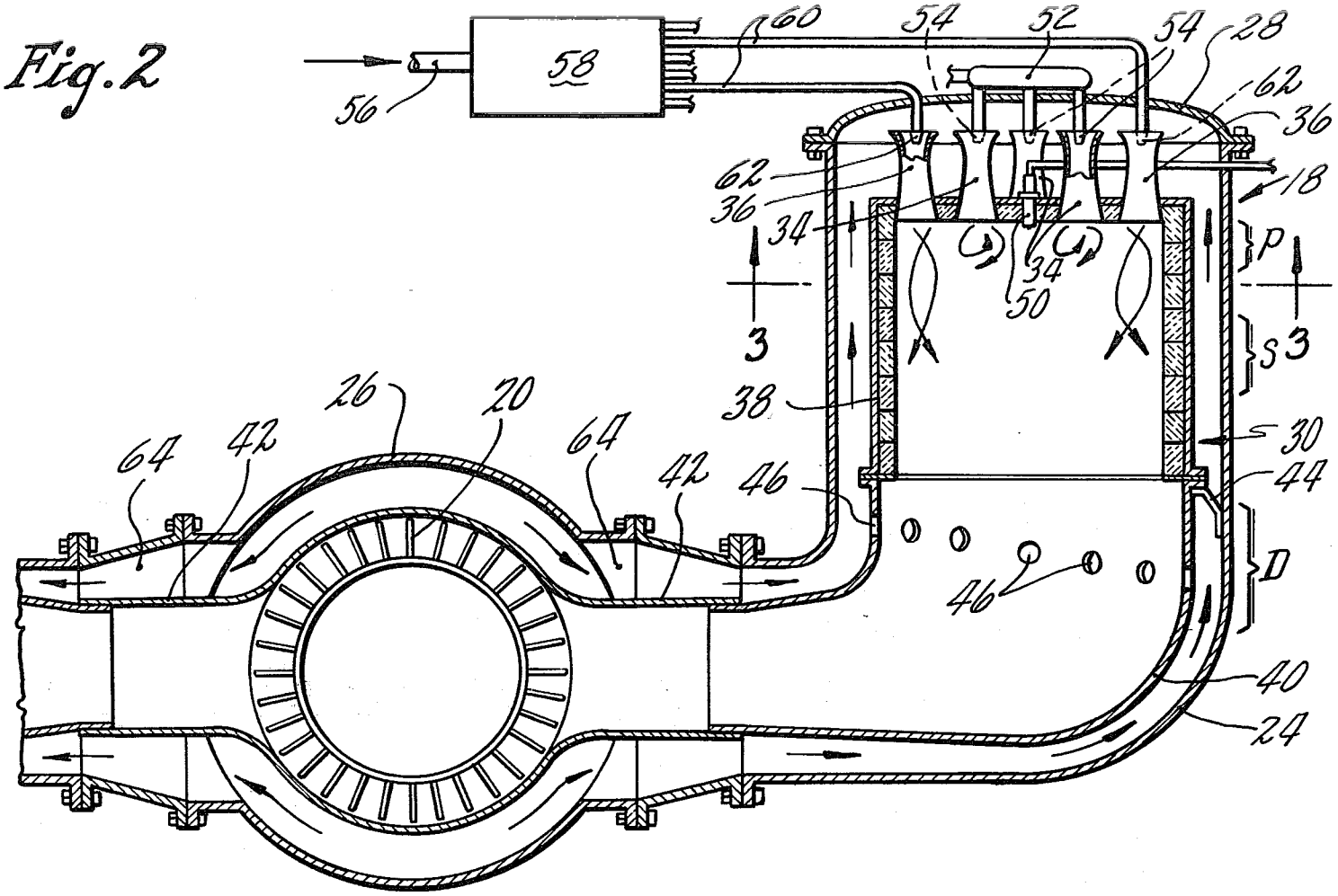
FIG. 2 is a cross-section view taken through the combustor of the type utilized in the FIG. 1 engine.

The FIG. 2 view is taken through the combustor 18 of such an engine. The combustor includes a housing 24 which is attached to one end to a case 26 of the engine. An end cap 28 closes the other end of the housing. A combustion chamber 30 having a front wall 32 is contained within the housing. A plurality of primary fuel premixing tubes 34 and a plurality of secondary fuel premixing tubes 36 are disposed at the front wall with the downstream ends of both the primary and secondary tubes terminating at the front wall. The chamber is formed principally of a combustion liner 38, a dilution liner 40 and a transition duct 42. The chamber is supported within the combustor housing 24 by suitable means such as the support 44. Dilution holes 46 are provided in the dilution liner. The transition duct leads to the engine flow path at the entrance to the turbine 20.

A spark igniter 50 is provided at the front wall of the chamber. A primary fuel supply line and manifold 52 is capable of delivering fuel to the primary nozzles 54 at the upstream end of the primary fuel premixing tubes 34. A secondary fuel supply line 56 leads to a distribution valve 58. The distribution valve is of the type capable of independently metering fuel to a plurality of secondary fuel delivery lines 60. Each secondary delivery line leads to a corresponding secondary nozzle 62 at the upstream end of a corresponding secondary fuel premixing tube 36.

In the operative mode compressed air from the compressor is flowed through the space 64 between the combustion chamber 30 and the housing 24 toward the end cap 28. At the end cap the compressed air is redirected into the primary fuel premixing tubes 34 and the secondary fuel premixing tubes 36. Fuel is simultaneously delivered to the primary nozzles 54 and under increased power demand conditions to one or more of the secondary nozzles 62. Fuel is mixed with the compressed air and flowed into the combustion chamber where the mixture is initially ignited by the spark igniter 50. The products of combustion are diluted with additional compressed air which is flowed to the interior of the chamber through the dilution holes 46 in the dilution liner 40 to reduce the temperature of the combustion products. The diluted combustion products are flowed through the transition duct 42 and thence to the turbine 20.

Figure 3:
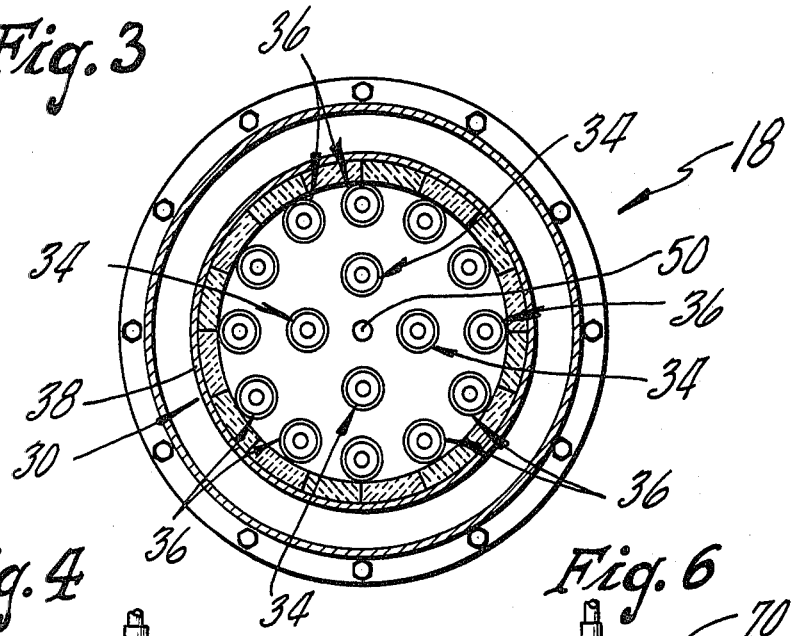
FIG. 3 is a sectional view taken along the line 3—3 as shown in FIG. 2.

A typical pattern of primary premixing tubes 34 and secondary premixing tubes 36 is illustrated by the FIG. 3 sectional view taken through the combustion chamber. As illustrated four (4) primary tubes and twelve (12) secondary tubes are employed in a front wall 32 having a cross-sectional area on the order of five thousand five hundred square inches (5500 sq. in.). Fuel is flowable to the primary tubes simultaneously. Fuel is flowable to the secondary tubes individually. Each of the primary tubes has a highly angled discharge swirler 66 at the downstream end thereof; each of the secondary tubes is illustrated without downstream swirler. In an alternate embodiment, lowly angled discharge swirlers may be employed at the discharge end of the secondary tubes. Primary discharge swirlers having vane angles on the order of forty-five degrees (45°) are capable of holding the fuel/air mixture discharging thereacross in sufficient proximity to the front wall of the chamber so as to separate the primary combustion zone P from the secondary combustion zone S. Products of both combustion zones are diluted in a dilution zone D.

Figure 4:
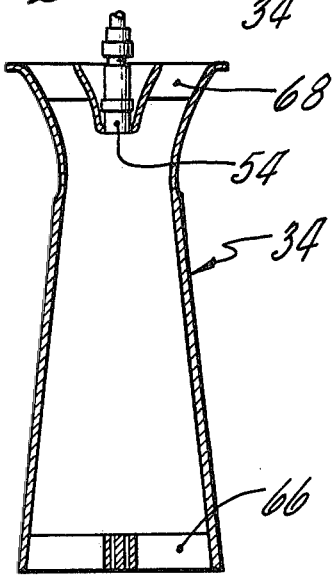
FIG. 4 is a cross-section view of a primary fuel premixing tube constructed in accordance with the concepts of the present invention.
Figure 6:
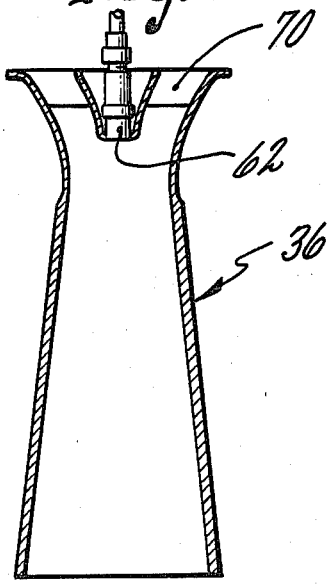
FIG. 6 is a cross-section view of a secondary fuel premixing tube constructed in accordance with the concepts of the present invention without an angled discharge swirler.
Figure 5:
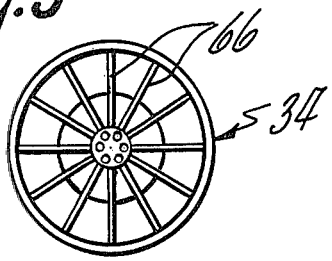
FIG. 5 is an end view of the FIG. 4 premixing tube showing a highly angled swirler.
Figure 7:
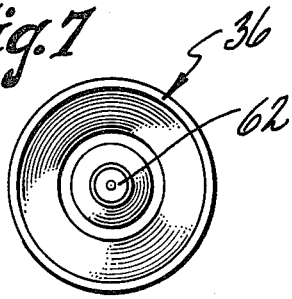
FIG. 7 is an end view of the FIG. 6 premixing tube.

Fuel premixing tubes of the type employable with the concepts of the present invention are illustrated in FIGS. 4–7. FIG. 4 represents a primary fuel premixing tube 34 with the primary fuel nozzle 54 disposed at the upstream end thereof. An inlet swirler 68 is positioned at the upstream end of the tube. The tubes are of a venturi type configuration to prevent the aspiration of fuel from the front end of the tube. A highly angled discharge swirler 66 is located at the downstream end of the primary tube. FIG. 5 shows the discharge swirler. FIG. 6 represents a secondary fuel premixing tube 36 with the secondary fuel nozzle 62 disposed at the upstream end thereof. An inlet swirler 70 is positioned at the upstream end of the tube. No discharge swirler is shown in the FIG. 6 tube. In alternate embodiments a lowly angled discharged swirler may be employed to encourage mixing of the fuel and air discharged thereacross. In all cases the angle of discharge swirlers of the secondary tube must not be so great as to prevent penetration of the fuel/air mixture well past the primary combustion zone P.

Figure 8:
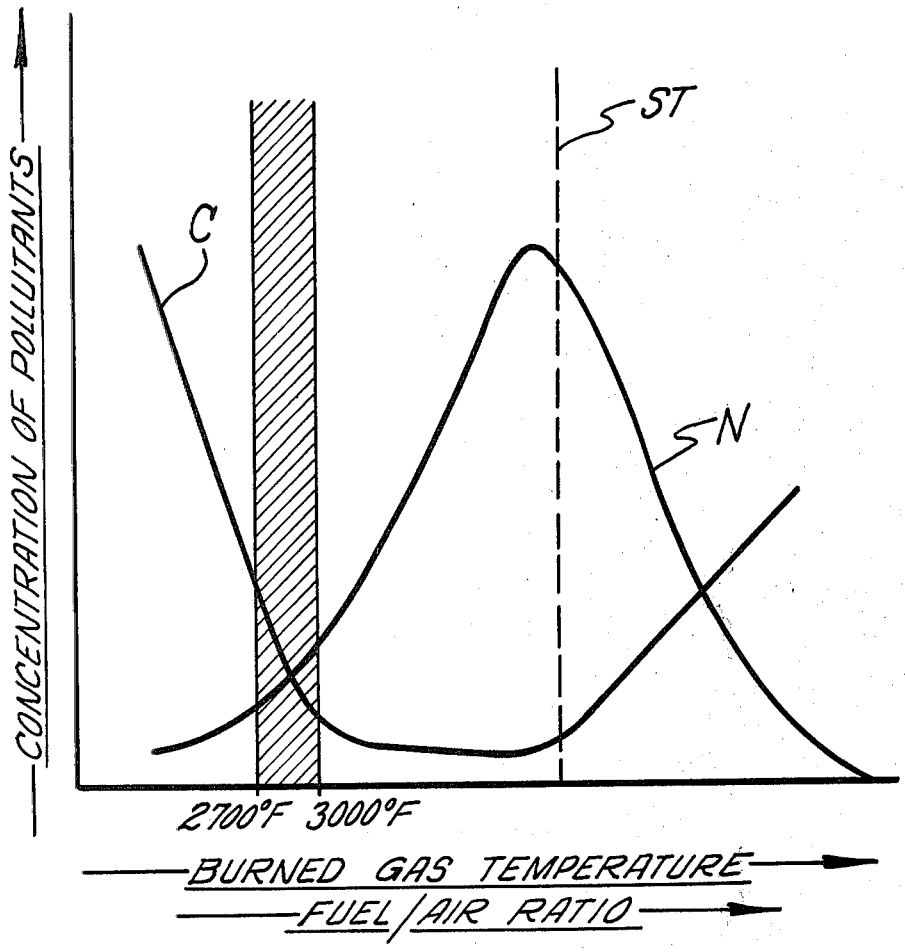
FIG. 8 is a graph illustrating the relationship between fuel/air ratio and the production of pollutants.

The combustor herein illustrated is most efficiently operated under what is known in the industry as "lean" fuel/air ratio conditions. The fuel/air ratio is less than the ratio for stoichiometric conditions. The FIG. 8 graph depicts the relative levels of pollutants produced for a given fuel/air ratio both above and below stoichiometric conditions.

The line C represents carbon based pollutants, mainly carbon monoxide and unburned hydrocarbons. The line N represents nitrogen based pollutants including the various oxides of nitrogen. At ratios less than stoichiometric conditions ST, the burned gas temperature is reduced and the level of nitrous oxides produced is correspondingly less. At burned gas temperatures greater than twenty-seven hundred degrees Fahrenheit (2700° F.) but less than the stoichiometric temperature carbon based pollutants are minimal. Combined carbon and nitrous oxide pollutants are at combined minimal values within the combustion temperature range of twenty-seven hundred to three thousand degrees Fahrenheit (2700°-3000° F.). It is within that temperature range that combustion within the chamber of the present invention is desired. Maintenance of local combustion temperatures within that range produces minimal pollutants. The corresponding fuel/air ratio at the local sites of combustion is apporoximately four hundredths (0.04) for typical engines having compression ratios on the order of twelve (12) to one (1). The optimum fuel/air ratio varies slightly with compression ratio, the optimum fuel/air ratio being less at increased compression ratios.

A principal problem of combustion which is addressed by the chamber of the present invention is both the prevention of excessively rich and excessively lean fuel/air ratios at any particular combustion site. The high angled swirler at the primary combustion site restricts combustion to the proximate location of the chamber front wall. The effluent from the primary tubes is the only source of fuel or air to the local region. Effluent discharging from the secondary tubes, with little or no swirl, penetrates the site of primary combustion without entering into the combustion reaction at that site and is delivered at a distance remote from the discharge end of the tube. When only air is discharging from any of the secondary tubes that constituent does not lean out the primary combustion mixture. Resultantly, at the primary combustion sites the fuel/air ratio is closely controllable and is unaffected by combustion or the absence of combustion at the secondary site. A low level of pollutants is emitted.

Similarly, at the secondary site, fuel and air emanating from the secondary tubes provide the primary constituents of combustion. Combusted gases from the primary side do pass through the secondary site, but unreacted air is not admitted until all of the gases pass through the secondary site into the dilution zone. Dilution rather than combustion air is admitted through the dilution holes at that location.

It is important to note that the above described separation of primary and secondary combustion zones is achievable without the penetration of structural apparatus into the combustion chamber. Both the primary premixing tubes and the secondary premixing tubes terminate at the front wall of the chamber. Structural and durability problems precipitated by the high temperatures in that area are thereby avoided.

Although the invention has been shown and described with respect to preferred embodiments thereof, it should be understood by those skilled in the art that various changes and omissions in the form and detail thereof may be made therein without departing from the spirit and the scope of the invention.

I claim:

1. A combustion chamber of the type suited for use in a gas turbine engine and of the type employing primary and secondary combustion zones, wherein the improvement comprises aerodynamic means for separating the zone of primary combustion from the zone of secondary combustion and includes:

one or more primary fuel premixing tubes terminating at the forward end of said combustion chamber and having a highly angled discharged swirler at the downstream end thereof for swirling effluent dischargeable therefrom in close proximity to the forward end of the chamber to establish the primary combustion zone in that region; and one or more secondary fuel premixing tubes terminating at the forward end of said combustion chamber, but which are adapted to discharge the effluent therefrom through said primary combustion zone to a secondary combustion zone at a location downstream of said primary combustion zone.

2. The invention according to claim 1 wherein each of said secondary fuel premixing tubes has a lowly angled discharge swirler at the downstream end thereof in comparison to the highly angled discharge swirlers of the primary premixing tubes to establish said separated zones of primary and secondary combustion.

* * * * *